US005375578A

United States Patent [19]

Kato et al.

[11] Patent Number: 5,375,578

[45] Date of Patent: Dec. 27, 1994

[54] HIGH PRESSURE FUEL FEEDING DEVICE FOR FUEL INJECTION ENGINE

[75] Inventors: Naoki Kato; Seiichi Nishimura, both of Iwata, Japan

[73] Assignee: Sanshin Kogyo Kabushiki Kaisha, Hamamatsu, Japan

[21] Appl. No.: 26,023

[22] Filed: Mar. 4, 1993

[30] Foreign Application Priority Data

Mar. 5, 1992 [JP] Japan ..... 4-83183
Mar. 5, 1992 [JP] Japan ..... 4-83184
Mar. 5, 1992 [JP] Japan ..... 4-83185

[51] Int. Cl.[5] ..... F02M 37/04; F02M 23/00
[52] U.S. Cl. ..... 123/516; 123/533
[58] Field of Search ..... 123/516, 531, 533, 510, 123/511, 515, 518

[56] References Cited

U.S. PATENT DOCUMENTS

| | | | |
|---|---|---|---|
| 4,754,740 | 7/1988 | Emmenthal et al. | 123/531 |
| 4,756,293 | 7/1988 | Suzuki et al. | 123/531 |
| 4,794,902 | 1/1989 | McKay | 123/531 |
| 4,841,942 | 6/1989 | McKay | 123/531 |
| 4,955,350 | 9/1990 | Albertson | 123/531 |
| 5,024,202 | 6/1991 | McKay | 123/531 |
| 5,054,457 | 10/1991 | Sakamoto | 123/531 |
| 5,103,793 | 4/1992 | Riese et al. | 123/516 |
| 5,150,692 | 9/1992 | Trombley et al. | 123/533 |
| 5,156,133 | 10/1992 | Sugimoto et al. | 123/533 |
| 5,245,974 | 9/1993 | Watson et al. | 123/533 |

FOREIGN PATENT DOCUMENTS

| | | |
|---|---|---|
| 61-118552 | 6/1986 | Japan . |
| 1-215694 | 8/1989 | Japan . |
| 3-23362 | 1/1991 | Japan . |
| 3-19464 | 2/1991 | Japan . |
| 3-31577 | 2/1991 | Japan . |
| 3-57876 | 3/1991 | Japan . |
| 3-64658 | 3/1991 | Japan . |

*Primary Examiner*—E. Rollins Cross
*Assistant Examiner*—Thomas N. Moulis
*Attorney, Agent, or Firm*—Knobbe, Martens, Olson & Bear

[57] ABSTRACT

A high pressure fuel/air injection system for an outboard motor having a V-cylinder arrangement wherein the major components of the air/fuel supply system are disposed in the valley between the cylinder banks. The system includes an vapor fuel separator that has a fuel chamber in which the supply of fuel is maintained by a float valve and an air chamber positioned above the fuel chamber and to one side of it and which communicates with the fuel chamber through a perforated member. A filter media fills the air chamber and an atmospheric air inlet is provided to the air chamber. Fuel pressure and fuel regulator valves are disposed in the area to the side of the air chamber and regulate fuel and air pressure by dumping fuel and air back to the fuel and air chambers, respectively, through integral internal conduits. The regulating system includes an arrangement for regulating the fuel pressure so that it will be at least greater than the air pressure by a predetermined amount and also for precluding the delivery of air under pressure if fuel under pressure is not supplied. The arrangement also incorporates a system for insuring that fuel cannot flow out of the atmospheric air inlet if the outboard motor is tilted up or is laid on its sides. An additional air supply is provided for the air compressor in the event the air chamber becomes clogged or inadequate to supply the air requirements for the system.

96 Claims, 11 Drawing Sheets

HIGH PRESSURE FUEL FEEDING DEVICE FOR FUEL INJECTION ENGINE

BACKGROUND OF THE INVENTION

This invention relates to a high pressure fuel feeding device for a fuel injected engine and more particularly to numerous improvements in such engines.

The advantages of high pressure fuel injection in the charge forming systems for internal combustion engines are well acknowledged. Fuel injection offers better control of the fuel/air mixture and also permits control of the position of the fuel/air charge in the combustion chamber at the time of ignition so as to permit stratification at low and part loads. Thus, there are particular advantages both for exhaust emission control and fuel economy to provide high pressure fuel injection systems. However, in order to provide such systems there are a number of factors which must be considered. For example, the use of fuel injection normally employs additional components to those of normally carbureted engines such as high pressure fuel pumps and pressure regulators. In order to add these components to the system, not only does cost become a factor but also the actual physical location of the components can present a problem. In addition, as further components are added to the system, the problem of possible leakage becomes significant.

It is, therefore, a principal object of this invention to provide an improved high pressure fuel injection system for an internal combustion engine wherein the number of connections and external components can be reduced.

One form of fuel injection system which is of considerable interest injects not only fuel but high pressure air into the engine. Such "fuel/air injectors" have some advantages over conventional fuel injectors. However, the addition of high pressure air to the high pressure fuel gives rise to additional problems in complexity. This is particularly true in view of the fact that the air pressure must be regulated as well as the fuel pressure.

It is, therefore, a still further object of this invention to provide an improved fuel/air injection system for an internal combustion engine.

One specific application for internal combustion engines wherein fuel and/or fuel/air injectors may have some interest is in outboard motors. Outboard motors frequently utilize two cycle internal combustion engines as their power plant due to the simplicity and high specific output of such engines. However, the exhaust emission control for such engines is also well known to be a substantial problem. The use of fuel and/or fuel/air injection for such engines may be useful in reducing exhaust emission control.

However, the problems as aforenoted with fuel injection and/or fuel/air injection systems become further complicated in connection with outboard motors. Specifically, an outboard motor requires an extremely compact arrangement and this further complicates not only the positioning of the various components but the insurance of effective sealing.

It is, therefore, a still further object of this invention to provide an improved injection system for an outboard motor.

In the co-pending application entitled "High Pressure Fuel Feeding Device For Fuel Injected Engine", Ser. No. 959,684, filed Oct. 13, 1992 in the name of Naoki Karo and assigned to the Assignee hereof, there is disclosed a high pressure fuel injection system for an outboard motor that avoids many of the difficulties of the prior art type constructions previously referred to. It is a further object of this invention to provide certain specific improvements over the systems shown in that application.

Specifically, that patent application discloses an arrangement wherein there is a fuel vapor separator positioned in the fuel supply system upstream of the high pressure fuel pump and which functions to separate vapors from the fuel. In that application, there is also provided an air pressure regulator and the air pressure regulation is achieved by dumping excess air pressure back to the fuel vapor separator and this will insure against the discharge of fuel vapors, which can become mixed with the air in the fuel/air injection system from being discharged to the atmosphere.

It is a further principal object of this invention to provide an improved fuel vapor separator arrangement and air compressor pressure regulation system wherein the air pressure is regulated by dumping air back to the fuel vapor separator and additional separation of fuel from the returned air in the fuel vapor separator is accomplished.

It is a further object of this invention to provide an improved fuel vapor separator for an fuel/air injection system for an internal combustion engine wherein the fuel vapor separator also processes the air which is delivered to the air compressor of the fuel/air injection system.

In the fuel vapor separator shown in the aforenoted copending application, the excess air which is dumped from the air pressure regulator is delivered to an air chamber which in turn communicates with the fuel vapor separator through a return conduit through which condensed fuel may return. However, such an arrangement may not be as fully effective as desirable in insuring that the maximum amount of fuel can be separated from the returned air and returned to the fuel vapor separator.

It is, therefore, a still further object of this invention to provide an improved fuel vapor separator for a fuel/air injection system wherein the air compressor of the engine has its pressure regulated by dumping excess air directly back to the fuel vapor separator through a perforate member which will insure complete separation of any fuel from the bypassed air.

As has been noted, it is extremely important, particularly with such applications as outboard motors, to provide a very compact assembly and nevertheless one which can be easily serviced. The construction shown in the aforenoted co-pending patent application provides a fuel vapor separator with the air pressure regulator and the fuel pressure regulator being positioned in close proximity to the fuel vapor separator and thus provides a compact assembly. However, the arrangement shown in that application requires a number of external conduits and these can provide leakage problems, as aforenoted.

It is, therefore, a still further object of this invention to provide an improved and compact fuel vapor separator, fuel pressure regulator and air pressure regulator for a fuel/air injection system for an engine which is compact in construction and which minimizes the number of required external components.

In the arrangement shown in the aforenoted co-pending application, the air for the air compressor is drawn at least in part from the fuel vapor separator. However, in that application the air component of the fuel vapor separator is separate from the fuel reservoir and this gives rise to certain problems, some of which have been aforenoted. In addition, with such a separate location it is not possible to provide the desired amount of air filtration as may be required.

It is, therefore, a still further object of this invention to provide a fuel vapor separator system for a fuel/air injection system for an internal combustion engine wherein the air and fuel chambers of the separator are positioned in close proximity to each other and wherein the air chamber is filled with a filter media for filtering air which is supplied to the air compressor of the system.

As has been previously noted, one desirable application for fuel/air injection systems is in outboard motors because of their normal use of two cycle engines as power sources. However, in addition to the problems as aforenoted, outboard motors provide a number of additional problems in connection with design and operation. For example, in an outboard motor it is common to adjust the trim of the outboard motor during operation. Trim adjustment normally is accomplished by means of pivotal movement about a horizontally disposed trim axis and this change in inclination of the engine and its associated components can give rise to certain problems.

For example, if the engine employs a fuel vapor separator and air is returned or drawn from the air chamber of the fuel vapor separator, inclination of the outboard motor can cause fuel to enter the air chamber and pass through one of the air passages. This is obviously undesirable. This problem is particularly acute when it is considered that the outboard motor may be detached from the associated watercraft and laid down while still having fuel in its system.

It is, therefore, a still further object of this invention to provide a fuel vapor separator for an outboard motor wherein the air portion of the separator can supply air to an air compressor and it will be insured that fuel cannot enter the air system.

As has been previously noted, systems of this type and those shown in the aforenoted co-pending application draw the air from the air compressor from the air chamber of the fuel vapor separator. Although this has the advantage of insuring that fuel cannot be discharged to the atmosphere, it may be that the amount of air supplied to the air compressor through such systems may be inadequate.

It is, therefore, a still further object of this invention to provide an improved fuel/air injection system for an internal combustion engine wherein adequate air is supplied to the air compressor under all running conditions.

As has been previously noted, when fuel/air injection systems are employed it is necessary to regulate both fuel pressure and air pressure. However, if the fuel pressure and air pressure are regulated independently of each other, this can cause undesirable variations in the fuel/air ratio.

It is, therefore, a further object of this invention to provide an improved pressure regulating system for air/fuel injector wherein the fuel and air pressures are both regulated and wherein the difference between the fuel and air pressure is also regulated.

In systems of the type described and particularly those in the aforenoted co-pending application wherein the system is at east partially closed in that the air and fuel are both contained within a common air/fuel separator, there can be a problem. If for some reason the supply of fuel is discontinued and high pressure air is still supplied to the air/fuel injector, this high pressure air can act back through the system and cause the undesirable discharge of fuel.

It is, therefore, a still further object of this invention to provide an improved fuel/air pressure regulating system wherein the supply of air under pressure will be discontinued in the event fuel pressure falls below a predetermined desired amount.

In addition to the problems as aforenoted, there are still additional problems in conjunction with fuel/air injection systems that are particularly acute in connection with outboard motors. As has been previously noted, with outboard motors the construction is quite compact and certain of the components are mounted directly on the engine. This means that engine vibrations can be transmitted to those components and cause undesirable results. For example, the fuel vapor separator normally employs a float operated valve and the vibrations if transmitted to the valve can cause malfunctions. In addition, the vibrations can cause weakening of the various air and fuel connections.

It is, therefore, a still further object of this invention to provide an improved arrangement for an fuel/air injection system for an engine wherein certain of the components are mounted resiliently or are themselves resilient so as to reduce the adverse effects of vibration.

SUMMARY OF THE INVENTION

A first feature of this invention is adapted to be embodied in a high pressure fuel/air injection system for an internal combustion engine comprising a plurality of fuel/air injectors positioned in a vertical array. A vertically extending air delivery manifold delivers high pressure air to the fuel/air injectors. Means are provided for delivering high pressure air to the vertically upper end of the air delivery manifold. An air pressure regulator for regulating air pressure by dumping excess air to a return is in communication with the lower end of the vertically extending air delivery manifold. A source of high pressure fuel including a fuel vapor separator for delivering high pressure fuel to the fuel/air injectors is also incorporated. Means are provided for returning the air from the air pressure regulator to the fuel vapor separator and a screen is provided in the fuel vapor separator upon which the returned air impinges for assisting in condensing any fuel contained in the returned air for separation therefrom.

A number of other features of the invention are adapted to be embodied in a fuel vapor separator system for a fuel injection system of an internal combustion, engine that comprises a housing defining a fuel cavity to which fuel is delivered and an air cavity in the housing above the fuel cavity and separated therefrom. A high pressure fuel pump pumps fuel from the fuel chamber to a fuel injection supply circuit that includes a fuel pressure regulator that regulates fuel pressure by bypassing excess fuel back to the fuel chamber. An air compressor draws air from the air chamber and delivers the air to the fuel/air injector through an air conduit which includes an air pressure regulator which controls air pressure by returning the excess air to the air chamber.

In accordance with a first feature of the invention incorporated in such a fuel vapor separator system, a perforate member separates the air cavity from the fuel cavity.

In accordance with another feature of the invention, the air cavity is formed to one side of the housing above the fuel cavity. The fuel pressure regulator and air pressure regulator are disposed adjacent the air cavity and communicate in part with the fuel and air chambers through internal conduits formed in the housing.

In accordance with another feature of the invention incorporated in such a fuel vapor separator system, a filter media fills the air chamber.

In accordance with yet another feature of the invention embodied in such a fuel vapor separator system, the air compressor draws air from the air chamber through an air inlet and the air pressure dumped by the air pressure regulator communicates with the air chamber through an air return. At least one of the air inlet and air returns communicate with the air chamber at a location wherein tilting of the housing will not cause fuel to enter the one air inlet or air return.

In accordance with another feature of the invention, the volume of the air chamber and its relation to the air inlet and air return is such that fuel cannot flow into the air inlet or air return if the housing is laid on a side.

Another feature of the invention is adapted to be embodied in a fuel injection system for an internal combustion engine that comprises an air compressor for compressing air. A fuel pump pumps fuel to a fuel vapor separator which separates vapor from the fuel. The air compressor draws at least part of the air compressed thereby from the fuel vapor separator and a separate air inlet is provided for supplying air to the air compressor in the event that drawn from the fuel vapor separator is not adequate.

A still further feature of the invention is adapted to be embodied in an fuel/air pressure regulator arrangement for an fuel/air injection system comprising an air compressor for compressing air and an air pressure regulator for regulating the pressure of the air supplied by the air compressor to the fuel/air injector. A fuel pump pressurizes fuel for the fuel/air injector. A fuel pressure regulator has a regulating valve which is opened and closed to regulate the fuel pressure and this regulating valve is opened and closed in response to the difference in pressure between the pressure generated by the fuel pump and the regulated air pressure.

A further feature of the invention is adapted to be embodied in an air pressure regulator system for a fuel-/air injector for supplying high pressure fuel and air to an internal combustion engine. An air compressor is supplied for compressing air and a fuel pump pumps fuel under pressure. An air pressure regulator regulates the pressure of air supplied by the air compressor to the fuel/air injector. Means are provided for precluding the delivery of high pressure air to the fuel/air injector if the fuel pump does not pump fuel to the fuel/air injector at greater than a predetermined pressure.

DETAILED DESCRIPTION OF THE PREFERRED EMBODIMENT OF THE INVENTION

Figure 1:
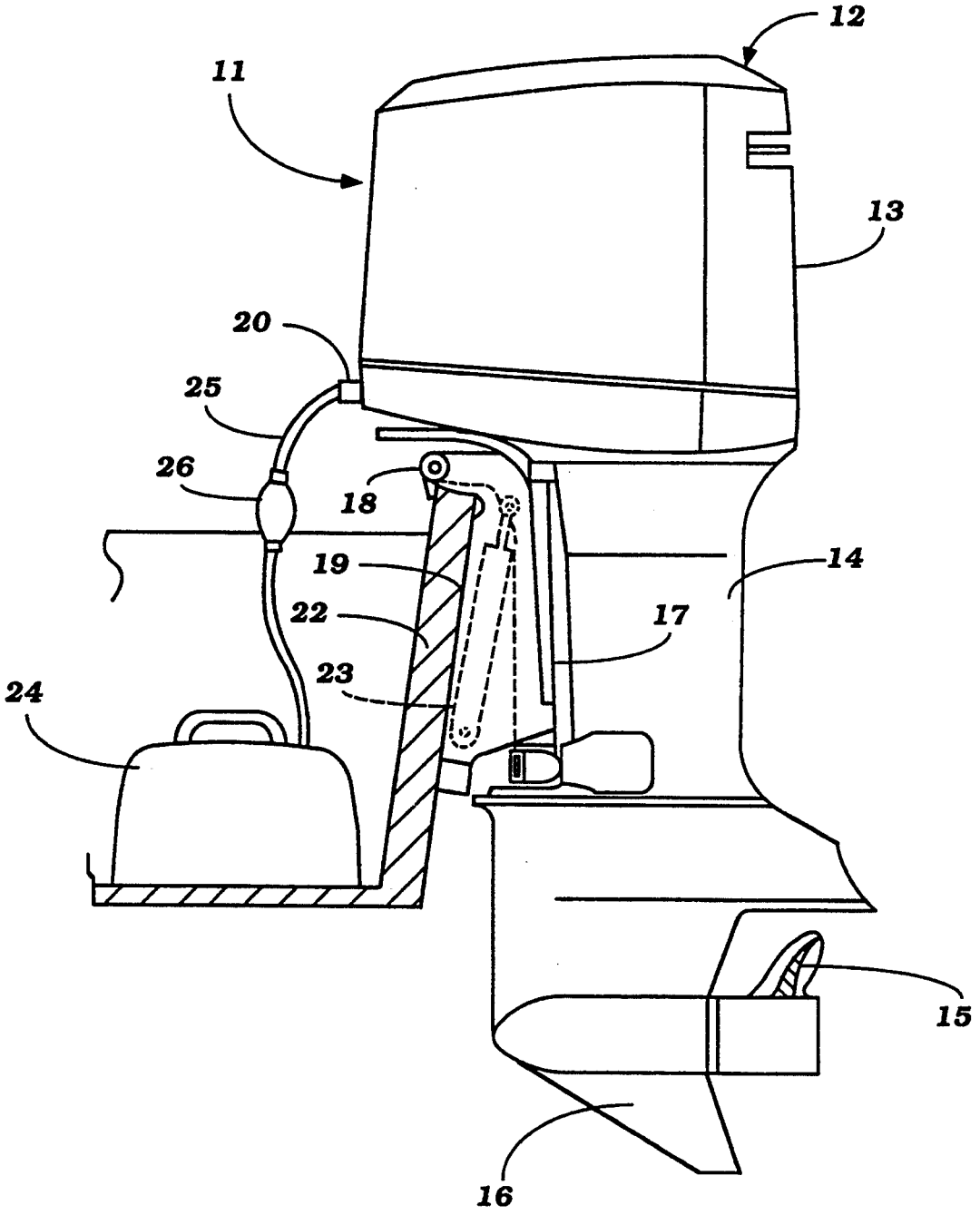
FIG. 1 is a side elevational view of an outboard motor constructed in accordance with an embodiment of the invention, as attached to the transom of a watercraft, shown partially and with portions in section.

Referring now in detail to the drawings and initially to FIG. 1, an outboard motor constructed in accordance with an embodiment of the invention is identified generally by the reference numeral 11. Although the invention is described in conjunction with an outboard motor, wherein it has particular utility, it is to be understood that the invention may be employed in conjunction with other applications for internal combustion engines.

The outboard motor 11 includes a power head, indicated generally by the reference numeral 12 which contains an internal combustion engine, which will be described by reference to the remaining figures, and a surrounding protective cowling 13. The engine contained within the power head 12 drives a vertically positioned driveshaft which is journaled within a driveshaft housing 14 that depends from the power head 12 and which drives a propeller 15 through a forward/neutral/reverse transmission contained within a lower unit 16.

A steering shaft (not shown) is affixed to the driveshaft housing 14 in a known manner is journaled for steering movement about a vertically extending steering axis within a swivel bracket 17. The swivel bracket 17 is, in turn, pivotally connected by means of a pivot pin 18 to a clamping bracket 19 for tilt and trim movement of the outboard motor 11 in a well known manner. The clamping bracket 19 carries a suitable device for attaching the clamping bracket 19 to a transom 21 of an associated watercraft, shown partially and in cross section and identified generally by the reference numeral 22. A hydraulic cylinder assembly, which may include a fluid motor 23 is interposed between the clamping bracket 19 and the swivel bracket 17 for tilt and trim damping and also for power tilt and trim movement, if a fluid motor is incorporated.

The invention relates primarily to the fuel injection system for the engine of the power head 12 and this includes a fuel system that is comprised of a main fuel storage tank 24 that is positioned in the watercraft hull 22. A conduit 25 in which a priming pump 26 is incorporated for connecting the fuel tank 24 with the fuel system of the power head 12 and a quick disconnect coupling 20 is provided for this purpose.

Figure 2:
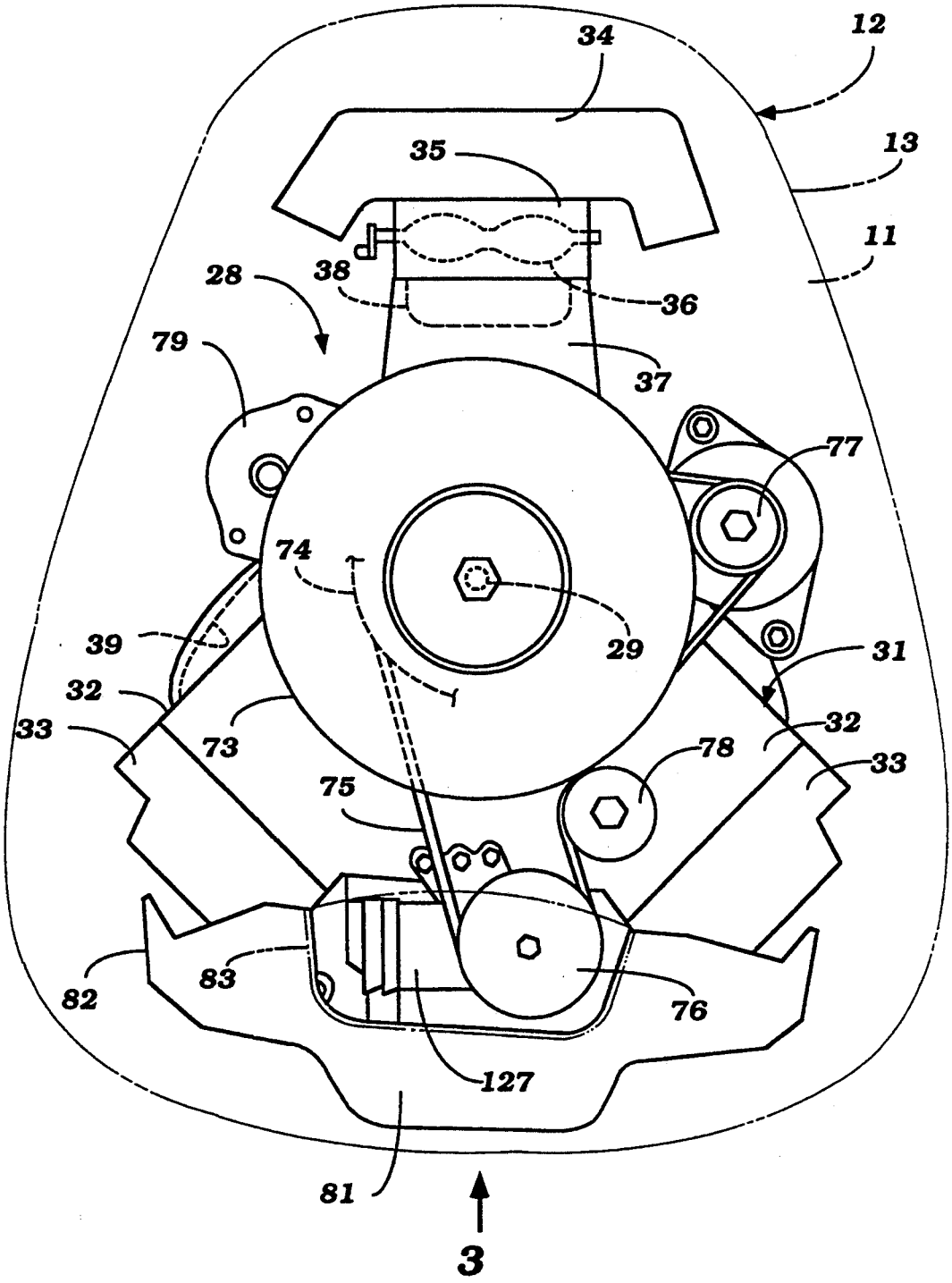
FIG. 2 is an enlarged top plan view of the power head of the outboard motor with the protective cowling shown in phantom.
Figure 3:
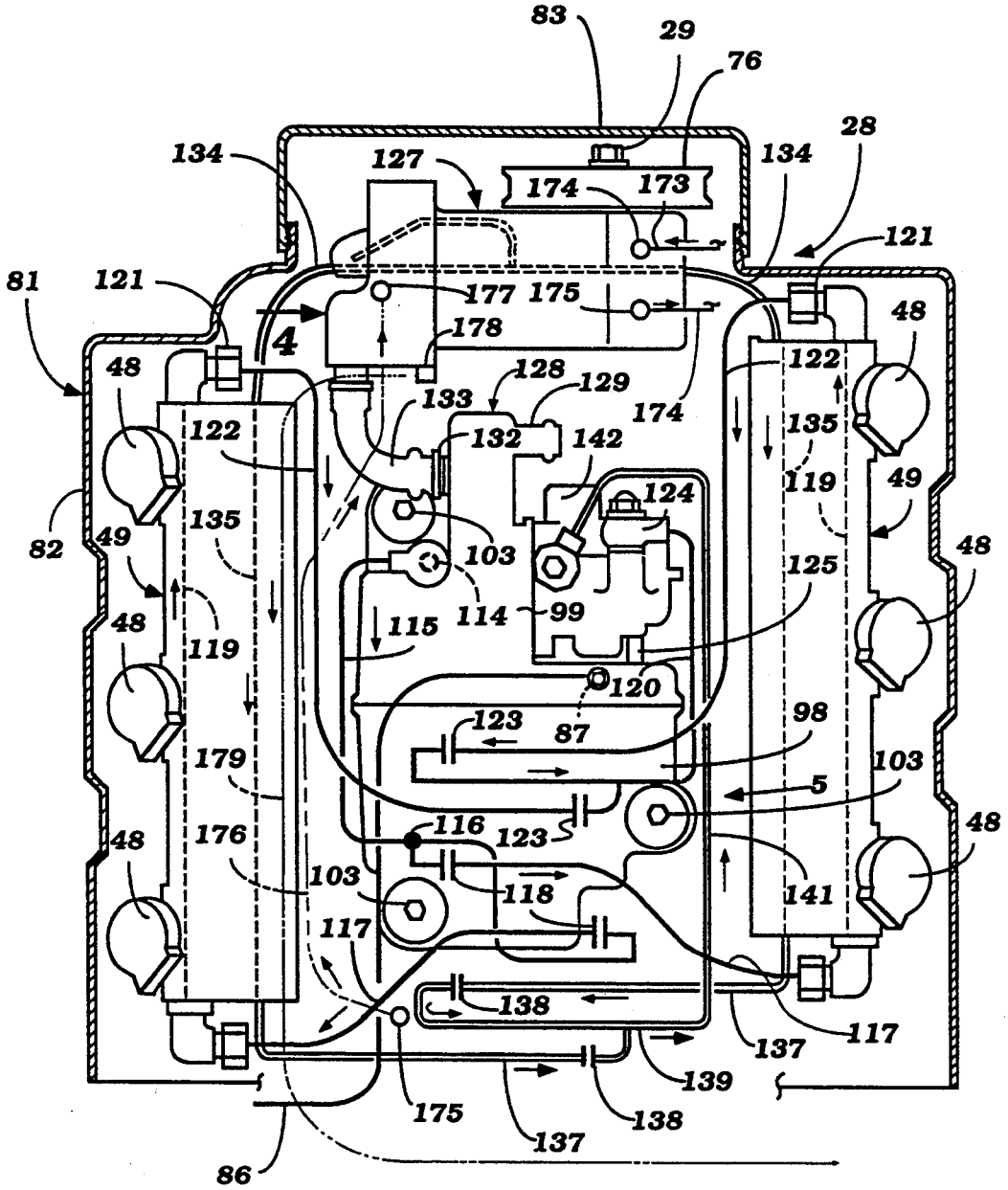
FIG. 3 is a rear elevational view taken in the direction of the arrow 3 in FIG. 2 with portions broken away.
Figure 4:
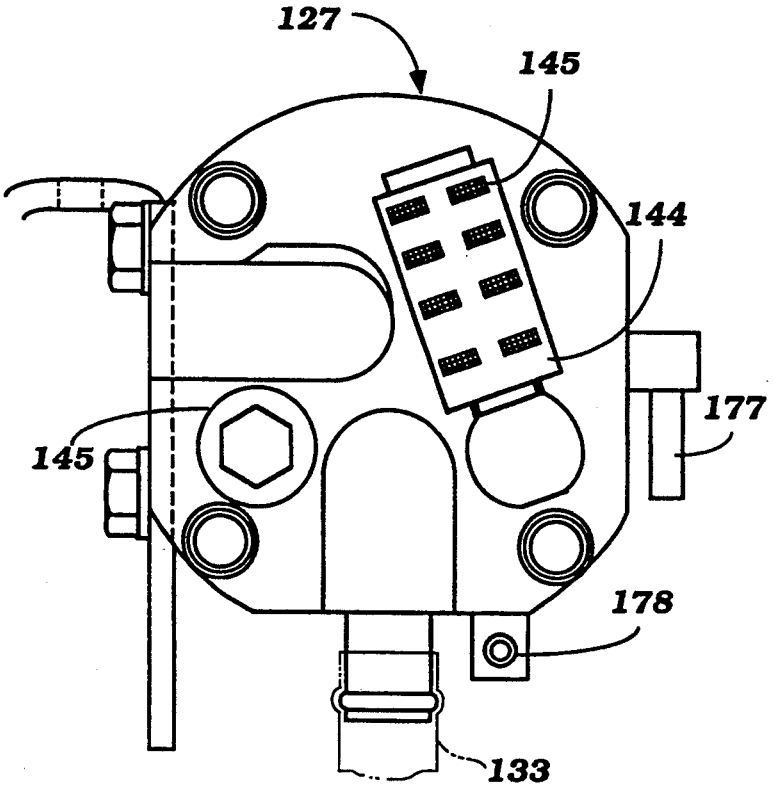
FIG. 4 is an enlarged view taken in the direction of the arrow 4 in FIG. 3 and shows the head of the air compressor and the alternate air supply therefor.

Referring now in detail to FIGS. 2 and 3, the engine associated with the power head 12 is depicted and identified generally by the reference numeral 28. Since the invention deals primarily with the fuel/air injection for the engine 28, for the most part only the external portion of the engine 28 has been illustrated. It is to be understood that the internal construction of the engine 28, except as may be hereinafter noted, may take any known type of construction and, for that reason, detailed description of the internal components of the engine are not necessary. In the illustrated embodiment, the engine 28 is depicted as being of the V-6 type and operates on the two-stroke crankcase compression principal. As should be readily apparent to those skilled in the art, the invention may be employed with engines of other types than two-cycle V-6 engines. However, certain facets of the invention have particular utility with such engines.

The engine 28 includes a crankcase in which a crankshaft 29 is supported for rotation about a vertically extending axis, as is typical with outboard motor practice and as has already been noted. This crankcase is defined in part by a cylinder block 31 having a pair of angularly disposed cylinder banks 32 in which three individual cylinders are provided. Cylinder head assemblies 33 are affixed to the cylinder banks 32 and, as aforenoted, the engine 28 has an otherwise conventional construction insofar as its internal details are concerned.

An air charge is admitted into the protective cowling 13 through suitable air inlet openings and is inducted into an induction device 34 which, in turn, supplies the air charge to a throttle body 35 in which throttle valves 36 are provided for controlling the speed of the engine in a well known manner. As is typical with two-cycle practice, there may be provided a pair of throttle valves 36 for each pair of cylinders of the cylinder banks 32. The air charge then flows into an intake manifold 37 for induction into the crankcase chambers of the engine, which are sealed from each other as is typical with two-cycle practice. Reed type check valves 38 are provided in the intake manifolds 37 for permitting the air to flow into the crankcase chambers but precluding reverse flow under compression.

The compressed charge is transferred to the combustion chambers of the engine through scavenge passages, one of which appears in cross section in FIG. 2 and is identified generally by the reference numeral 39. As with the other internal details of the engine 28, any known type of scavenging system may be employed.

Figure 9:
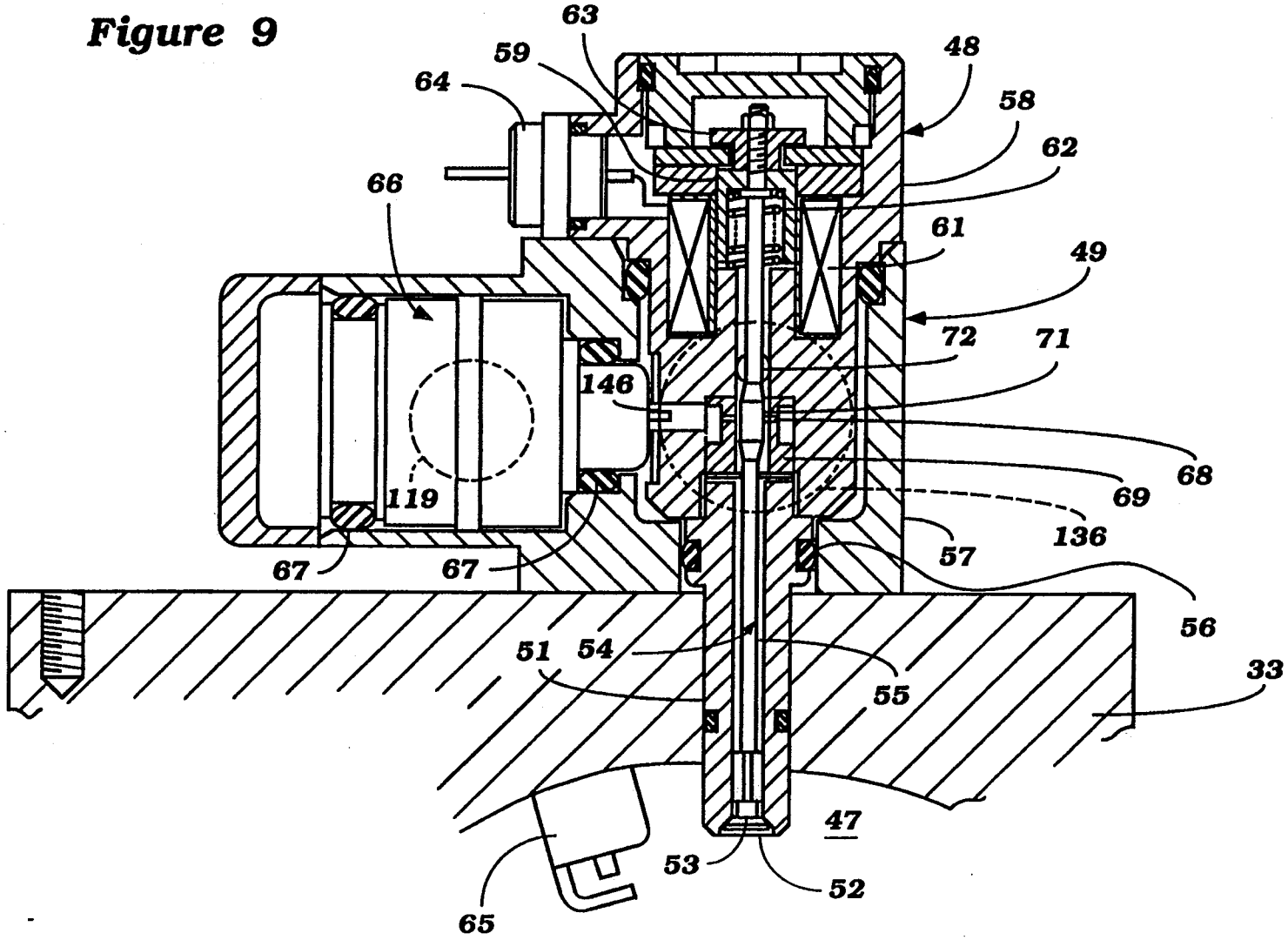
FIG. 9 is an enlarged cross sectional view taken through the cylinder head of the engine and showing one of the fuel/air injectors.

A fuel/air charge is delivered to the individual combustion chambers of the engine, one of which appears in FIG. 9 and is identified generally by the reference numeral 47 by means of fuel/air injectors, indicated generally by the reference numeral 48. Although the invention is described in conjunction with a fuel/air injection system, it is to be understood that the invention may be practiced in conjunction with engines that have injectors that inject only fuel. However, certain facets of the invention have particular utility in conjunction with fuel/air injectors, as will be apparent to those skilled in the art.

The fuel/air injectors 48 include a multi-piece outer housing assembly 49 which may include portions common to all injectors 48 for each cylinder bank as shown in FIG. 3. The assembly 49 includes a pilot or nozzle portion 51 which is mounted into the cylinder head 33 and has a tip that forms a valve seat 52 which extends into the combustion chamber 47. A head or valving portion 53 of an injection valve 54 opens and closes the communication of a chamber 55 formed within the housing assembly 49 with the combustion chamber 47, for a purpose to be described.

The nozzle piece 51 has an annular groove which carries an O ring seal 56 to seal with a second housing piece 57 common to all injectors 48 and which is affixed in a suitable manner to the cylinder head 33 and which contains a pilot portion of a third housing piece 58. The upper end of the injection valve 54 has affixed to it an armature 59 that is slidably supported within the housing piece 58 and which is encircled by a solenoid winding 61. A coil compression spring 62 is engaged with the armature piece 59 which is held in place by an adjustable stop member 63 and normally urges the injection valve 54 to its closed position. The solenoid winding 61 is energized by means of a terminal 64 which is connected to a suitable ECU (not shown) so as to draw the armature 59 and injection valve 54 downwardly to move the valve head 53 away from the valve seat 52 so as to permit a fuel/air charge, generated in a manner to be described, to be injected into the combustion chamber 47. This charge is then fired by a spark plug 65 at an appropriate time interval.

A fuel charge is supplied under pressure to the chamber 55 by means of individual electronic fuel injectors 66 that are mounted to the housing piece 58 with O ring seals 67 being provided around their periphery. Fuel is supplied to the fuel injectors 66 in a manner to be described and the fuel injectors spray into the chamber 55 through one or more orifices 68 formed in a ring piece 69 that is held between the housing pieces 58 and 51. In addition, compressed air is supplied to the chamber 55 from a system as will be described and this includes a passageway 72 that intersects an area above where the injection valve 54 is provided with a first cylindrical portion 71 that extends in communication with the orifices 68 when the injection valve 54 is in its closed position.

The injectors 48 may be of the precharged type wherein all of the fuel is supplied to the chamber 55 before the injection valve 54 is opened or of the non-precharged type wherein fuel is supplied by the injector 66 when the injection valve 54 is opened. In either event, the air under pressure will assist in atomization of the fuel which enters the combustion chamber 47 through the valve seat 52 when opened by the headed portion 53. Again, the specific details of the fuel injector 48 are not deemed to be necessary to understand the construction and operation of the invention.

The invention is directed primarily to the system which supplies fuel and air to the injectors 48 and its location relative to the engine and this arrangement is best shown in FIGS. 2 through 8 with the components being shown schematically in FIG. 11 so as to indicate how these components are provided within the various cowlings and enclosures, which will be described.

Referring again to FIGS. 2 and 3, the upper portion of the engine 28 is provided with an accessory drive for driving certain components in addition to components of the fuel/air injection system. These components include a flywheel magneto 73 that is affixed appropriately to the upper end of the crankshaft 29 and which drives the ignition and generating system for the engine including the ignition system for firing the spark plugs 65.

A drive pulley 74 is affixed to the crankshaft 29 below the flywheel magneto 73 and drives a drive belt 75 which, in turn, drives an air compressor drive pulley 76 and an alternator drive pulley 77. An idler tensioner pulley 78 is adjustably carried by the cylinder block 31 for maintaining the appropriate tension on the drive belt 75. An electric starter 79 may be carried by the upper end of the cylinder block 31 and cooperates with a starter gear (not shown) on the flywheel magneto 73 for electric starting of the engine 28.

Figure 11:
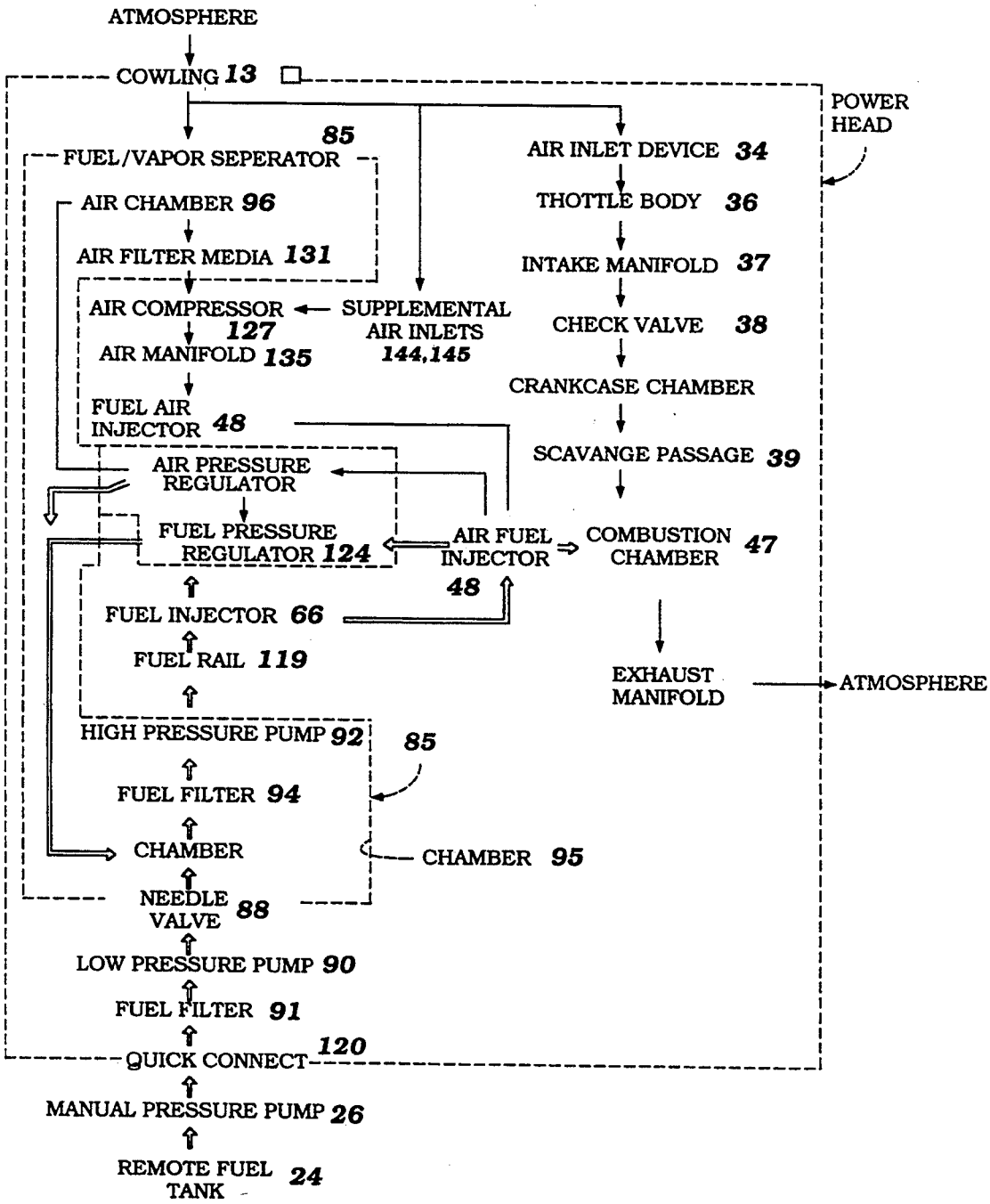
FIG. 11 is a partially schematic view showing certain components of the fuel/air injection system in relation to their orientation on the outboard motor and the manner in which the components may be enclosed to avoid fuel leakage externally of the system.

Referring now to both the fuel and air systems for the fuel/air injectors 48, this construction appears in most detail in FIGS. 2 through 6 and the location of the various components appears in FIG. 11. A major component of this fuel/air injection system is a sealed housing assembly, indicated generally by the reference numeral 81, which is positioned conveniently in the valley between the cylinder banks 32 as is clearly shown in FIG. 2. This housing assembly 81 is comprised of a main housing piece 82 and a removable cover 83 so as to in essence provide an air tight inner chamber. A number of components, as will be described, are contained within this inner chamber.

The first of these components comprises a combined vapor separator, fuel storage tank 85 (FIGS. 3 and 6) to which fuel is admitted through a conduit 86 that communicates with the quick disconnect coupling 20 and receives fuel under pressure from the remote fuel tank 24 via a low pressure engine driven pump 90 and filter 91 (FIG. 11). An internal passageway 87 terminates at a needle valve 88 which is operated by a float 89 so as to maintain a uniform head of fuel in the fuel vapor separator 85.

A high pressure fuel pump 92 is supported within the fuel vapor separator 85 and has an inlet fitting 93 which is submerged below the fuel level and which draws fuel through a fuel filter 94 submerged in the vapor separator 85. It should be noted that the vapor separator 85 is divided into a lower liquid fuel chamber 95 and an upper air chamber 96 separated by a horizontal perforated wall 97 with the pump 92 being positioned in the fuel chamber 95. The perforated partition wall 97 serves a function to be noted.

Because the high pressure pump 92 is contained within the fuel chamber 95 there will be insured adequate supply of fuel to it and also there will not be a necessity for a separate supply conduit. In addition, this submersion of the pump 92 gives rise to effective silencing of the operation of the pump 92.

It should be noted that the fuel storage tank, fuel vapor separator 85 is comprised primarily of two outer housing components consisting of a lower portion 98 and an upper portion 99 which are affixed to each other with a sealing gasket 101 being interposed in their mating interfaces. The lower fuel chamber 95 is primarily formed by the lower portion 98 while the upper air chamber 96 is formed primarily by the upper portion 99. These portions 98 and 99 are affixed to each other in a suitable manner.

It should be noted that the housing portions 98 and 99 are formed with a plurality of enlarged circular openings 102 (there being 3 in the illustrated embodiment) which pass threaded fasteners 103 with interposed elastic grommets 104 so as to affix the fuel vapor separator and storage tank 85 to the cylinder block in the "V" area between the cylinder banks 32. However, the elastic grommets 104 provide vibration absorbing mounting for the components that will insure that vibrations of the engine will not be transmitted to the needle valve 88 which would tend to cause it to open and close in response to these vibrations.

In a similar manner, the high pressure electric fuel pump 92 is contained between the housing portions 98 and 99 by means of a pair of lower and upper elastic isolators 105 and 106 so as to resiliently mount the high pressure electric fuel pump 92 in the fuel chamber 95 and to insure further against sound transmission.

Figure 6:
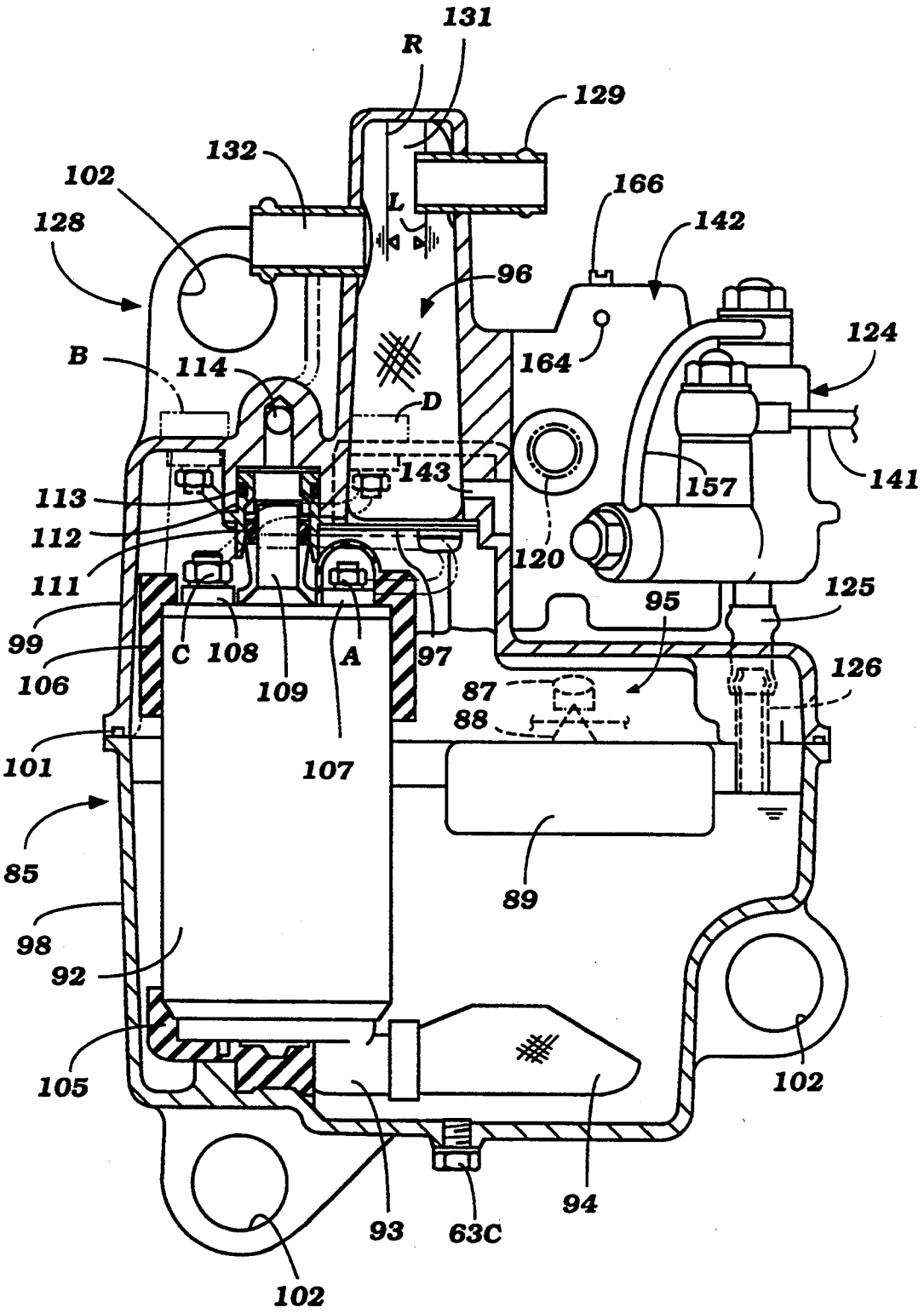
FIG. 6 is an enlarged cross sectional view taken through the fuel vapor separator.

It will also be noted that the air chamber 96 is disposed above but to one side of the fuel chamber 95 and thus provides a generally "L" shaped configuration as clearly shown in FIG. 6. The advantages of this construction will be described.

The electric high pressure fuel pump 92 is provided with a pair of terminals "A" and "C" on its upper face which are mounted on respective insulating bosses 107 and 108 and which are connected to suitable internal conduits which extend to external terminals "B" and "D" formed on the outer part of the housing of the fuel vapor separator 85 for connection to an external source of electrical power.

As should be readily apparent any vapors or air which are contained in the fuel that is delivered to the fuel chamber 95 will tend to rise through the perforated plate 97 and collect in the air chamber 96. As a result, vapor separation is achieved in the fuel storage tank vapor separator 85.

The upper end of the high pressure fuel pump 92 is provided with an outlet fitting 109 of generally cylindrical configuration which is sealingly engaged on its outer periphery by an O ring seal 111 formed in an outlet fitting 112 which is pressed or otherwise received into a counter bore formed in the upper housing portion 99. A further O ring seal 113 completes the sealing of the outlet fitting 112. A discharge passageway 114 is formed in the upper housing portion 99 and receives the high pressure fuel from the pump 92.

A discharge conduit 115 extends from the discharge filling 114 and communicates with a T-fitting ].16 at the lower portion of the vapor separator and fuel tank portion 85. The T-fitting 116 serves a pair of branch conduits 117 in which quick disconnects 118 are formed and which extend to respective fuel rails or manifolds 119 (FIGS. 3 and 9) that are associated with each cylinder head 33 and which form the means for supplying fuel to the fuel injector 66 of the fuel/air injectors 48 of the respective cylinder banks. The fuel rails 119 are formed integrally in the injector housing pieces 57.

The upper ends of the fuel rails 119 are provided with return fittings 121 which communicate with return lines 122. These return lines 122 include quick disconnects 123 which communicates with a fuel pressure regulator 124 through a line 120.

The fuel pressure regulator 124 regulates the pressure of fuel supplied to the fuel injectors 66 through the fuel rails 119 by dumping excess pressure back to the inlet side of the high pressure pump 92 and specifically to the fuel chamber 95 through a return line 125. The return line 125 engages a return fitting 126 that extends integrally through the upper wall of the fuel vapor separator line 85. The specific manner of regulation will be described later to reference to FIGS. 7 and 8.

The air supply will now be described by reference to the FIGS. 2–6. As has been noted, the drive belt 75 drives a air compressor drive pulley 76. This drive pulley 76 is connected to the crankshaft of a single or two piston, reciprocating type air compressor 127.

An air inlet device, indicated generally by the reference numeral 128 is provided within the upper portion of the vapor separator housing assembly 85 for delivering filtered air to the air compressor 127. The air inlet device 128 includes the air chamber 96 formed by the upper housing portion 99 and into which atmospheric air may be drawn from within the protective cowling 13 through an atmospheric air inlet 129. This inlet is positioned at one side of the upper end of the air chamber 96 as shown in FIG. 6 and for a reason to be described. A filter media 131 of any known type is provided within the air chamber 96. The filter media 131 will extract foreign particles from the air which is drawn into the air chamber 96 through the inlet 129 as well as assisting in fuel separation. This filtered air is then delivered to an outlet opening 132 which extends into the upper portion of the air chamber 96 on the side opposite the inlet 129 and slightly below it. A flexible conduit 133 connects the outlet 132 to the inlet side of the air compressor 127.

As has been noted, the air compressor 127 may be of any desired configuration and its cylinder head assembly is provided with intake and delivery check valves. The intake check valve permits flow from the inlet conduit 133 to the compressor for compression while the delivery check valve permits the discharge of the compressed gases. Such constructions are well known in this art and, for that reason, further description of the construction and operation of the compressor 127 per se is not believed to be necessary to enable those skilled in the art to practice the invention.

The air which has been compressed by the compressor 127 is discharged through discharge conduits 134 which, in turn, delivers the compressed air to a pair of air manifolds 135 formed integrally in the injector body portions 49. The air manifolds 135 have supply passages 136 which delivers air to the individual fuel/air injectors 48 (FIG. 9). As has been previously noted, these supply passages 136 intersect the portion of the fuel/air injector where the orifices 68 are provided in the ring like number 69 so as to flow into the chambers 55 of the respective fuel/air injectors 48.

A return conduit 137 is provided at the opposite or lower end of each of the air manifolds 135. The return conduits 137 have quick disconnect couplings 138 and are connected at their opposite ends at a T-fitting 139 (FIG. 4) which is positioned in the lower end of the valley. A further return air conduit 141 extends upwardly and terminates at an air pressure regulator 142 positioned immediately adjacent the fuel pressure regulator 124 and which forms a unit within and the air fuel vapor separator 85.

The air pressure regulator 142 regulates the air pressure that is supplied to the fuel/air injectors 48 by dumping excess air through a return as will be described. The air dumped by the air pressure regulator 142 is returned internally to the air chamber 96 of the fuel vapor separator assembly 85 through an internal conduit 143 (FIG. 6) formed therein so as to insure that there will be no leakage through external conduits. The manner in which the air pressure is regulated will be described later by reference to FIGS. 7 and 8.

It should be apparent that the air which is returned to the vapor fuel separator 85 by the air pressure regulator 142 may have fuel vapors present in it. The filter media 131 and the impingement of the air flow on the perforated plate 97 will tend to cause any fuel vapors to condense out and these fuel vapors will enter the fuel chamber 95 for recirculation through the fuel supply circuit. Thus, it should be readily apparent that the air pressure which has been regulated will add to the air flowing to the air compressor 127.

In some instances, the mere provision of the air flow to the air compressor 127 from the air chamber 96 of the fuel vapor separator 85 may not be adequate to supply all of the air needs for the system. To insure adequate air flow, the cylinder head of the air compressor 127 may be provided with one or more additional air inlet devices and silencers 144 each of which includes a respective air filter 145 that will filter the air drawn into the air compressor 127. However, it is desirable to insure that the primary air flow to the air compressor 127 is the air drawn through the air chamber 96 of the fuel vapor separator 85.

The way in which the fuel pressure is regulated by the fuel pressure regulator 124 and the air pressure is regulated by the air pressure regulator 142 will now be described in particular detail by reference to FIGS. 7 and 8. As will become apparent as this description proceeds, it will be noted that in addition to regulating the air pressure and the fuel pressure, the regulator assembly also regulates the ratio between the air pressure and the fuel pressure so that the fuel pressure will always be introduced at a higher pressure than the air pressure. In addition, the device includes a system wherein it will be insured that air pressure cannot be generated in the fuel/air injectors 48 in the event no fuel pressure is present. This will prevent the undesirable possibility that air could be driven into the fuel system and cause the fuel in the fuel system to back up.

Figure 10:
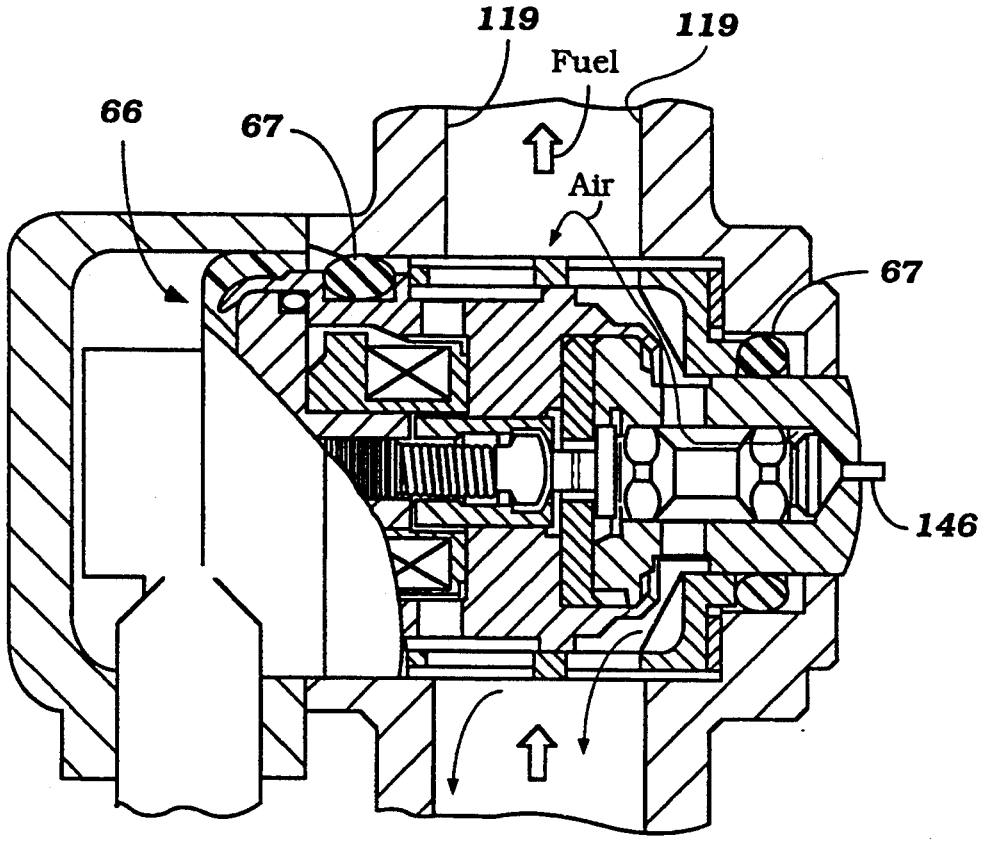
FIG. 10 is a further enlarged cross sectional view showing the fuel injector portion of the system and depicting the effect that may occur if high pressure air is introduced into the fuel system.

FIG. 10 is a view which shows how this situation might otherwise happen and this figure shows an enlargement of the fuel injection portion of the fuel/air injectors 48. As may be seen in this figure, the fuel injectors 66, which may be of any known type, has an injection control valve 146 which is opened and closed by an electrical solenoid or the like. If air pressure is exerted in the air chamber including the orifices 68 of the injector, and this air pressure is greater than the fuel pressure, the air pressure could flow past through the injector valve 146 into the fuel manifold 119 as shown by the arrows in FIG. 10 and cause a back pressure which is undesirable and which could adversely effect the operation of the fuel vapor separator 85 and also could cause fuel to back up in this system. As noted an arrangement is provided for preventing such a situation.

Figure 7:
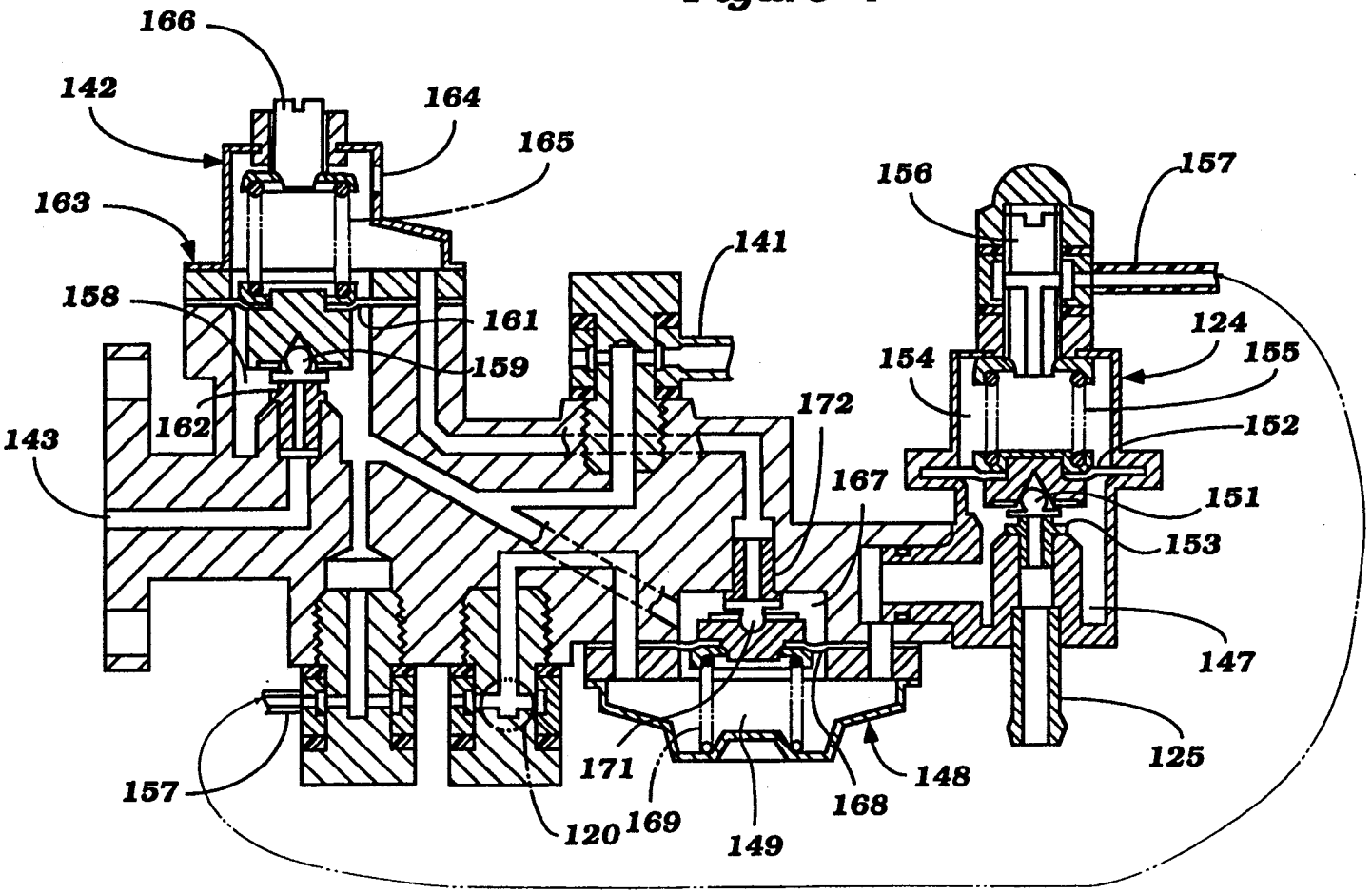
FIG. 7 is a cross sectional view taken along a plane generally parallel to the plane of FIG. 6 with certain of the components shown in other positions so as to more clearly show the relationship of the air/fuel pressure regulators of the system and their interrelationship.
Figure 8:
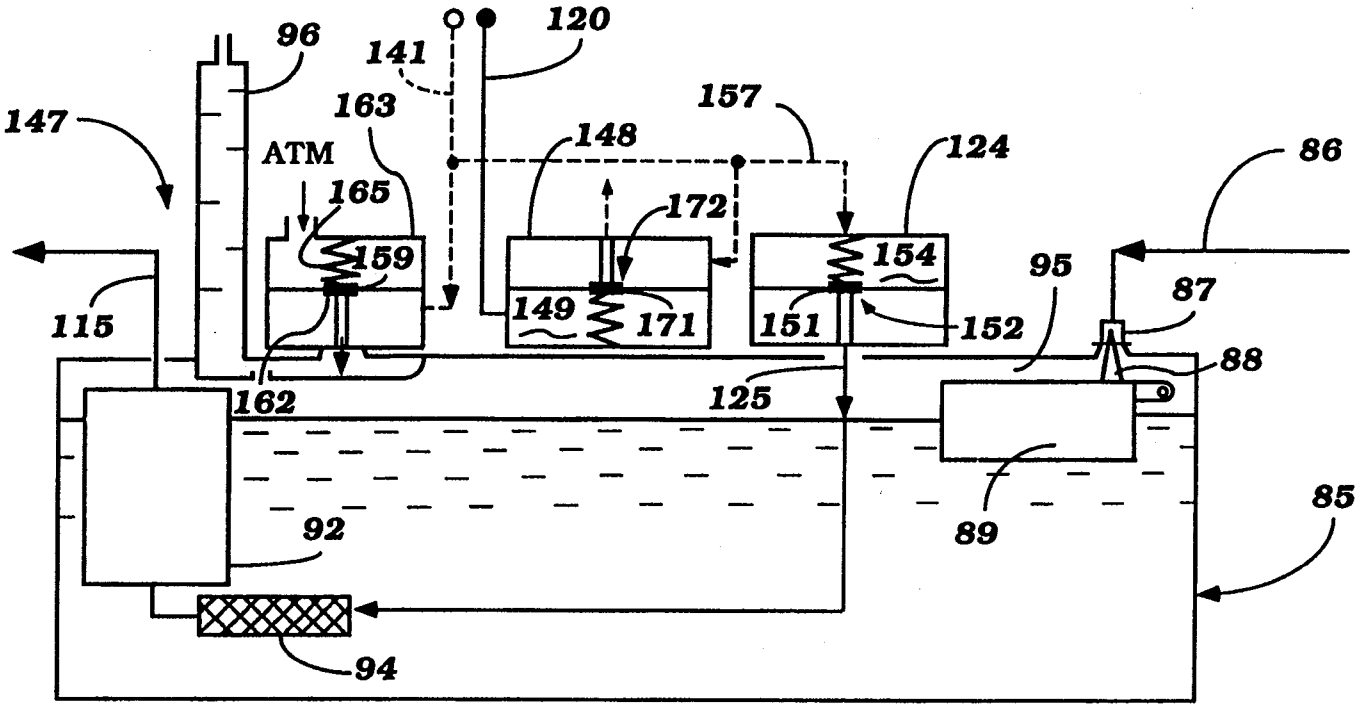
FIG. 8 is a partially schematic view showing the air/fuel pressure regulators and their relationship to the fuel vapor separator.

Referring now to FIGS. 7 and 8, it should be noted that the fuel pressure regulator 124 includes a regulating chamber 147 to which fuel is delivered under pressure through the conduit 120 which also passes through a further air shutoff valve 148 and specifically a chamber 149 thereof, which will be further described. A valve element 151 which is carried by a diaphragm 152 normally engages a valve Seat 153 and closes communication of the fuel pressure chamber 147 with the return conduit 125 which returns the fuel to the fuel chamber 95 as previously noted.

A further chamber 154 is provided on the upper side of the diaphragm 152 and this chamber contains a coil compression spring 155 the tension of which may be adjusted by an adjusting screw 156. An air pressure conduit 157 supplies regulated air pressure, in a manner to be described, to the upper chamber 154. Hence, the fuel pressure regulator 124 will regulate fuel pressure not only in response to an absolute amount but also to provide a fuel pressure that is greater than the air pressure which difference is determined by the preload of the spring 155.

The air pressure regulator will now be described by reference again to FIGS. 7 and 8 and it is indicated generally by the reference numeral 142. The air pressure regulator 142 includes a first air pressure regulating chamber 158 that communicates with the air pressure return channel 141. A control valve 159 is carried by a diaphragm 161 which forms the upper portion of the chamber 158 and is adapted to open and close a valve seat 162 so as to dump excess air back to the fuel vapor separator air chamber 96 through the passageway 143 previously mentioned.

The diaphragm 161 is held in place by means of a cover plate 163 which defines an atmospheric air chamber open to the atmosphere through an air port 164 and in which a compression spring 165 is contained. An adjusting screw 166 varies the pressure on the compression spring 165 and thus the air pressure which is maintained in the air supply system of the fuel/air injectors 48.

As has been previously noted, it is desirable to insure that high air pressure is not supplied to the system when there is not also a supply of high pressure fuel. Hence, the air cutoff valve 148 previously referred to is provided. As has been previously noted, the air cutoff valve 148 includes a chamber 149 that receives the fuel under pressure at the regulated pressure maintained by the fuel pressure regulator 124. A further chamber 167 is formed above a diaphragm 168 which defines the upper end of the chamber 149. A coil compression spring 169 is maintained in the chamber 149 and normally urges a control valve 171 carried by the diaphragm 168 into closing engagement with a valve seat 172. The valve seat 172 communicates the chamber 168, when open with the atmospheric chamber of the air pressure regulator 142 and with the atmospheric air vent 164. Hence, as long as adequate fuel pressure is exerted in the fuel pressure chamber 149 along with the action of the spring 169, the air shutoff valve 148 will be maintained in its closed position and full air supply will be afforded to the fuel/air injection system of the engine and specifically the fuel/air injectors 48. If, however, due to some failure such as low speed of the high pressure fuel pump 92 or fuel leakage, the pressure in the fuel chamber 149 will be inadequate to offset the air pressure in the air pressure chamber 167 and the diaphragm 168 will be urged downwardly to compress the spring 169 and relieve the air pressure through the atmospheric bleed 164. Hence, it will be insured that excess air pressure cannot be exerted in the system in the event fuel pressure falls below the desired amount.

Figure 5:
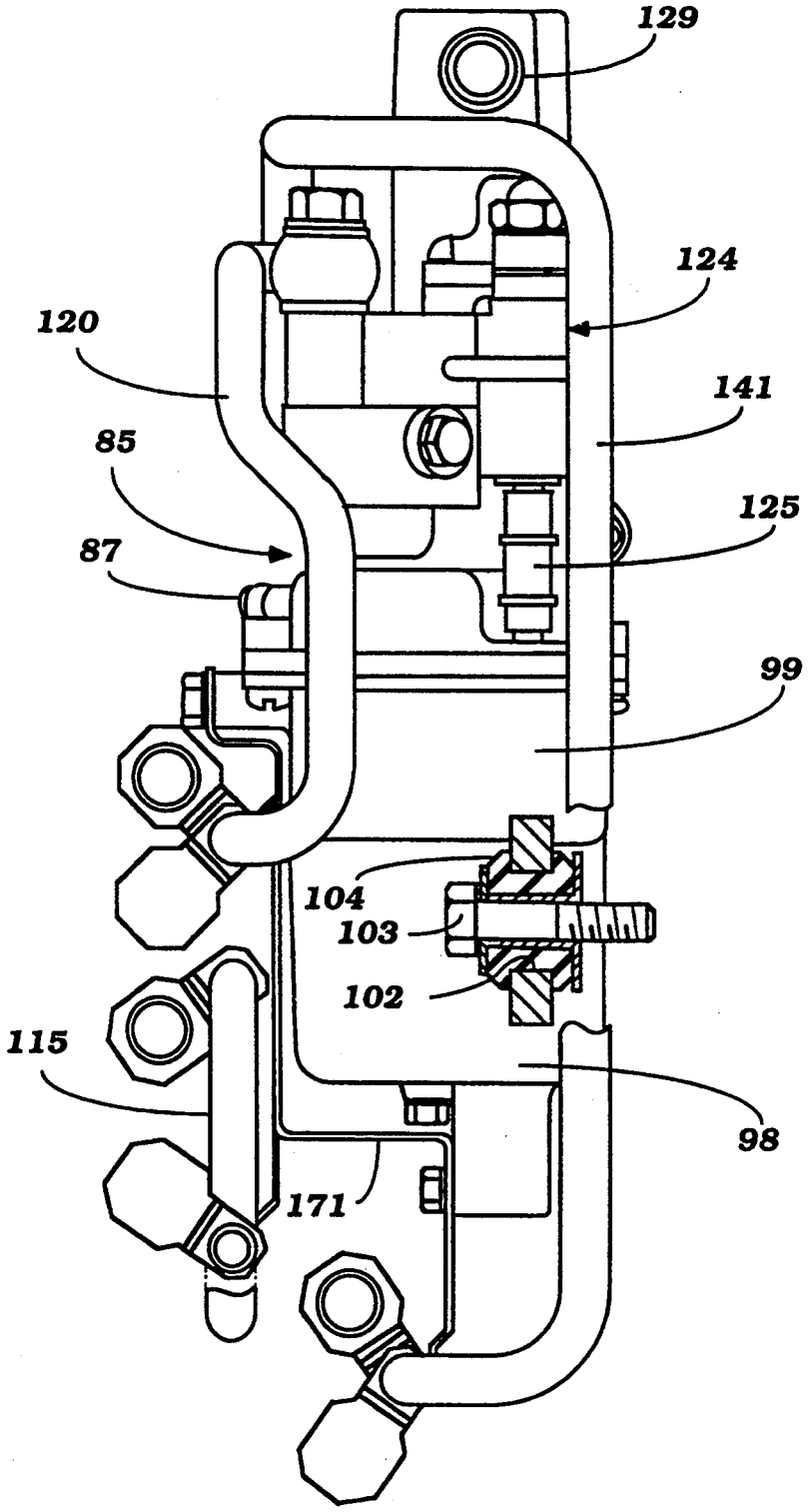
FIG. 5 is an enlarged view taken in the direction of the arrow 5 in FIG. 3 and shows the relationship of certain of the conduitry to the fuel vapor separator and the air and fuel pressure regulators.

It has been previously noted that the fuel vapor separator 85 is mounted resiliently in ! the valley between the cylinder banks. This permits all of the conduits, both air and fuel, going to the individual cylinder banks to have substantially the same length and the resilient mounting insures that vibrations of the engine will not be transmitted to the system. In addition, some of the conduits and specifically the air supply conduits 134, return conduits 139 and fuel supply conduits 117 are flexible and thus insures against the likelihood of the connections being shaken loose or becoming weakened. The conduits and specifically the conduits 115, 120 and 141 are steel tubes are mounted resiliently to the fuel vapor separator 85 by resilient brackets 171 as shown in FIG. 5 so as to further insure integrity of the system and avoidance of the likelihood of components being able to work loose because of vibrations. Even though some steel tubes are employed, the use of the quick disconnect couplings 123, 118 and 138 permits the fuel vapor separator 85 to be easily removed as a unit for servicing.

With outboard motors it is well known that the trim is adjusted during running of the operation. Such trim adjustment can, therefore, cause pivotal movement of the vapor fuel separator 85 and this could cause a variation in the fuel level therein and might also, in extreme cases, cause fuel to move into the air chamber 96. In fact, at times the outboard motor is disassociated from the associated watercraft and may be laid on its front or rear sides. The volume of the air chamber 96 and the placement of the atmospheric air inlet 129 are such that regardless of whether the outboard motor is laid on its forward side as indicated by the line "R" or on its rearward side as indicated by the line "L" any fuel that will enter the chamber 96 cannot pass out of the atmospheric air inlet opening 129. This will avoid the possibilities of fuel leakage.

The air compressor 127 is provided with a lubricating system which receives lubricant from the engine through a conduit 173 and fitting 174 for lubricating the internal components of the compressor 127. This lubricant is then returned to the engine lubricating system through a return fitting 175 and return conduit 176.

In addition, the air compressor and specifically its cylinder head assembly is water cooled and it receives coolant from an outlet 175 of the engine cooling jacket. A conduit 176 interconnects the engine cooling jacket outlet with a compressor cylinder head cooling inlet fitting 177 for circulation through the cylinder head of the air compressor. The coolant is then discharged back to the body of water in which the watercraft is operating from a cylinder head coolant discharge fitting 178 and return conduit 179.

It should be readily apparent from the foregoing description that the described construction provides a very compact assembly in which the minimum number of external components are supplied and wherein the fuel and air pressure supplied to the fuel/air injectors are regulated dependently upon each other and wherein it will be insured that air will not be supplied to the system when fuel under pressure is not available. The other objects aforestated have also been demonstrated to have been met by the described construction, which is to be understood to be a preferred embodiment of the invention in that various changes and modifications may be made without departing from the spirit and scope of the invention, as defined by the appended claims.

We claim:

1. A high pressure fuel/air injection system for an internal combustion engine comprising a plurality of fuel/air injectors positioned in a vertical array, a vertically extending air delivery manifold for delivering high pressure air to said fuel/air injectors, means for delivering a source of high pressure air to a vertically upper end of said air delivery manifold, an air pressure regulator for regulating air pressure by dumping excess air to a relief, a source of high pressure fuel including a vapor fuel separator for delivering high pressure fuel to said fuel/air injector, means for returning the excess air from said air pressure regulator to said vapor fuel separator, and a screen in said vapor fuel separator upon which the excess air impinges for assisting in condensing any fuel contained in said excess air.

2. A high pressure fuel/air injection system as set forth in claim 1 wherein the engine comprises a V-type internal combustion engine having angularly disposed cylinder banks each with a plurality of cylinders, and a plurality of vertically arrayed fuel injectors for each cylinder bank.

3. A high pressure fuel/air injection system as set forth in claim 2 wherein the vapor fuel separator is disposed in the valley between the cylinder banks.

4. A high pressure fuel/air injection system as set forth in claim 3 wherein the engine forms a powering internal combustion engine of a power head of an outboard motor supported for tilt adjustment.

5. A high pressure fuel/air injection system as set forth in claim 4 wherein the vapor fuel separator is resiliently mounted on the engine in the valley.

6. A high pressure fuel/air injection system as set forth in claim 5 wherein the vapor fuel separator comprises a fuel cavity to which fuel is delivered from a fuel pump and a float operated needle valve for controlling the level of fuel in said fuel cavity.

7. A high pressure fuel/air injection system as set forth in claim 6 wherein the conduits delivering fuel and air to the fuel vapor separator are flexible conduits.

8. A high pressure fuel/air injection system as set forth in claim 1 wherein the vapor fuel separator comprises an outer housing defining a fuel cavity to which fuel is delivered and an air cavity in said housing above said fuel cavity and separated therefrom by the perforated member.

9. A high pressure fuel/air injection system as set forth in claim 8 wherein the means for delivering high pressure air to the fuel/air injectors comprises an air compressor drawing air from the air cavity of the fuel vapor separator for compression thereby.

10. A high pressure fuel/air injection system as set forth in claim 9 wherein the air cavity is offset to one side of the fuel cavity and the air pressure regulator is disposed in the area to the side of the air cavity and wherein the air is returned to the air cavity through a passage formed integrally within the housing.

11. A high pressure fuel/air injection system as set forth in claim 10 wherein the engine comprises a V-type internal combustion engine having angularly disposed cylinder banks each with a plurality of cylinders and a plurality of vertically arrayed fuel injectors for each cylinder bank.

12. A high pressure fuel/air injection system as set forth in claim 11 wherein the vapor fuel separator is disposed in the valley between the cylinder banks.

13. A high pressure fuel/air injection system as set forth in claim 12 wherein the engine forms a powering internal combustion engine of a power head of an outboard motor supported for tilt adjustment.

14. A high pressure fuel/air injection system as set forth in claim 9 further including a filter media filling said air cavity.

15. A high pressure fuel/air injection system as set forth in claim 14 wherein atmospheric air is also delivered to the air cavity at an upper end thereof for delivery to the air compressor.

16. A high pressure fuel/air injection system as set forth in claim 15 wherein the air cavity is provided with sufficient capacity so that if the vapor fuel separator is laid on its side, fuel will not flow from the air cavity out of the atmospheric air inlet.

17. A high pressure fuel/air injection system as set forth in claim 16 wherein the engine comprises a V-type internal combustion engine having angularly disposed cylinder banks each with a plurality of cylinders and a plurality of vertically arrayed fuel injectors for each cylinder bank.

18. A high pressure fuel/air injection system as set forth in claim 17 wherein the vapor fuel separator is disposed in the valley between the cylinder banks.

19. A high pressure fuel/air injection system as set forth in claim 18 wherein the engine forms a powering internal combustion engine of a power head of an outboard motor supported for tilt adjustment.

20. A high pressure fuel/air injection system as set forth in claim 9 further including means providing an additional atmospheric air inlet to the air compressor independently of the air cavity.

21. A high pressure fuel/air injection system as set forth in claim 20 wherein atmospheric air is also delivered to the air cavity at an upper end thereof for delivery to the air compressor.

22. A high pressure fuel/air injection system as set forth in claim 21 wherein the air cavity is provided with sufficient capacity so that if the vapor fuel separator is laid on its side, fuel will not flow from the air cavity out of the atmospheric air inlet.

23. A high pressure fuel/air injection system as set forth in claim 22 wherein the engine comprises a V-type internal combustion engine having angularly disposed cylinder banks each with a plurality of cylinders and a plurality of vertically arrayed fuel injectors for each cylinder bank.

24. A high pressure fuel/air injection system as set forth in claim 23 wherein the vapor fuel separator is disposed in the valley between the cylinder banks.

25. A high pressure fuel/air injection system as set forth in claim 24 wherein the vapor fuel separator is resiliently mounted on the engine in the valley.

26. A high pressure fuel/air injection system as set forth in claim 1 further including a fuel pressure regulator for regulating the pressure of fuel delivered to said fuel/air injectors by bypassing excess fuel back to said vapor fuel separator.

27. A high pressure fuel/air injection system as set forth in claim 26 wherein the pressure of the fuel regulated is regulated to provide a predetermined pressure difference between the air pressure regulated by the air pressure regulator and the fuel pressure regulated by the fuel pressure regulator.

28. A high pressure fuel/air injection system as set forth in claim 27 further including means for shutting off the supply of high pressure air to the fuel/air injectors if the fuel pressure supplied to the fuel injectors falls below a predetermined value.

29. A high pressure fuel/air injection system as set forth in claim 28 wherein the vapor fuel separator comprises an outer housing defining a fuel cavity to which fuel is delivered and an air cavity in said housing above said fuel cavity and separated therefrom by the perforated member.

30. A high pressure fuel/air injection system as set forth in claim 29 wherein the means for delivering high pressure air to the fuel/air injectors comprises an air compressor drawing air from the air cavity of the fuel vapor separator for compression thereby.

31. A high pressure fuel/air injection system as set forth in claim 30 wherein the air cavity is offset to one side of the fuel cavity and the air pressure regulator is disposed in the area to the side of the air cavity and wherein the air is returned to the air chamber through a passage formed integrally within the housing.

32. A high pressure fuel/air injection system as set forth in claim 28 further including a filter media filling said air cavity.

33. A high pressure fuel/air injection system as set forth in claim 32 wherein atmospheric air is also delivered to the air cavity at an upper end thereof for delivery to the air compressor.

34. A high pressure fuel/air injection system as set forth in claim 33 wherein the air cavity is provided with sufficient capacity so that if the vapor fuel separator is laid on its side, fuel will not flow from the air cavity out of the atmospheric air inlet.

35. A high pressure fuel/air injection system as set forth in claim 28 further including means providing an additional atmospheric air inlet to the air compressor independently of the air cavity.

36. A vapor fuel separator system for a fuel/air injection system for an internal combustion engine comprising a housing defining a fuel cavity to which fuel is delivered, an air cavity in said housing above said fuel cavity and separated therefrom by a perforated member, a high pressure fuel pump for pumping fuel from said fuel cavity to a fuel injection supply circuit including a fuel pressure regulator that regulates fuel pressure by bypassing excess fuel back to said fuel cavity, and an air compressor for drawing air from said air cavity and delivering said air to said fuel/air injector through an air circuit including an air pressure regulator which controls air pressure by returning excess air to said air cavity.

37. A vapor fuel separator system as set forth in claim 36 wherein the air cavity is offset to one side of the fuel chamber and the air pressure regulator is disposed in the area to the side of the air cavity and wherein the air is returned to the air cavity through a passage formed integrally within the housing.

38. A vapor fuel separator system as set forth in claim 37 further including a filter media filling said air cavity.

39. A vapor fuel separator system as set forth in claim 38 wherein atmospheric air is also delivered to the air cavity at an upper end thereof for delivery to the air compressor.

40. A vapor fuel separator system as set forth in claim 39 wherein the air cavity is provided with sufficient capacity so that if the vapor fuel separator is laid on its side, fuel will not flow from the air cavity out of the atmospheric air inlet.

41. A vapor fuel separator system as set forth in claim 36 further including a filter media filling said air cavity.

42. A vapor fuel separator system as set forth in claim 41 wherein atmospheric air is also delivered to the air cavity at an upper end thereof for delivery to the air compressor.

43. A vapor fuel separator system as set forth in claim 42 wherein the air cavity is provided with sufficient capacity so that if the vapor fuel separator is laid on its side, fuel will not flow from the air cavity out of the atmospheric air inlet.

44. A vapor fuel separator system as set forth in claim 36 further including means providing an additional atmospheric air inlet to the air compressor independently of the air cavity.

45. A vapor fuel separator system as set forth in claim 44 wherein atmospheric air is also delivered to the air cavity at an upper end thereof for delivery to the air compressor.

46. A vapor fuel separator system as set forth in claim 45 wherein the air cavity is provided with sufficient capacity so that if the vapor fuel separator is laid on its side, fuel will not flow from the air cavity out of the atmospheric air inlet.

47. A vapor fuel separator system as set forth in claim 36 wherein the pressure of the fuel regulated is regulated to provide a predetermined pressure difference between the air pressure regulated by the air pressure regulator and the fuel pressure regulated by the fuel pressure regulator.

48. A vapor fuel separator system as set forth in claim 47 further including means for shutting off the supply of high pressure air to the fuel/air injectors if the fuel pressure supplied to the fuel injectors falls below a predetermined value.

49. A vapor fuel separator system as set forth in claim 36 further including means for shutting off the supply of high pressure air to the fuel/air injectors if the fuel pressure supplied to the fuel injectors falls below a predetermined value.

50. A vapor fuel separator system as set forth in claim 36 wherein the associated engine has a pair of cylinder banks disposed at an angle and defining a valley therebetween.

51. A vapor fuel separator system as set forth in claim 50 wherein the vapor fuel separator is disposed in the valley between the cylinder banks.

52. A vapor fuel separator system as set forth in claim 51 wherein the engine forms a powering internal combustion engine of a power head of an outboard motor supported for tilt adjustment.

53. A vapor fuel separator system as set forth in claim 52 wherein the vapor fuel separator is resiliently mounted on the engine in the valley.

54. A vapor fuel separator system as set forth in claim 53 wherein the vapor fuel separator comprises a float operated needle valve for controlling .the level of fuel in the fuel cavity.

55. A vapor fuel separator system for an fuel/air injection system of an internal combustion engine comprising a housing defining a fuel cavity to which fuel is delivered, an air cavity in said housing above and to one side of said fuel cavity and communicating therewith, a high pressure fuel pump for pumping fuel from said fuel cavity to a fuel injection supply circuit including a fuel pressure regulator disposed adjacent said air cavity and which regulates fuel pressure by bypassing excess fuel back to said fuel cavity through a passage formed in said housing, and an air compressor for drawing air from said air chamber and for delivering air to said fuel/air injector through an air circuit including an air pressure regulator disposed adjacent said air chamber and which controls air pressure by returning excess air to said air cavity through a passage formed integrally in said housing.

56. A vapor fuel separator system as set forth in claim 55 further including a filter media filling said air cavity.

57. A vapor fuel separator system as set forth in claim 56 wherein atmospheric air is also delivered to the air cavity at an upper end thereof for delivery to the air compressor.

58. A vapor fuel separator system as set forth in claim 57 wherein atmospheric air is also delivered to the air cavity at an upper end thereof for delivery to the air compressor.

59. A vapor fuel separator system as set forth in claim 55 wherein the associated engine has a pair of cylinder banks disposed at an angle and defining a valley therebetween.

60. A vapor fuel separator system as set forth in claim 59 wherein the vapor fuel separator is disposed in the valley between the cylinder banks.

61. A vapor fuel separator system as set forth in claim 60 wherein the engine forms a powering internal combustion engine of a power head of an outboard motor supported for tilt adjustment.

62. A vapor fuel separator system as set forth in claim 61 wherein the vapor fuel separator is resiliently mounted on the engine in the valley.

63. A vapor fuel separator system as set forth in claim 62 wherein the vapor fuel separator comprises a float operated needle valve for controlling the level of fuel in the fuel cavity.

64. A vapor fuel separator system as set forth in claim 63 wherein the conduits delivering fuel and air to the fuel vapor separator are flexible conduits.

65. A vapor fuel separator system as set forth in claim 55 further including means providing an additional atmospheric air inlet to the air compressor independently of the air cavity.

66. A vapor fuel separator system as set forth in claim 65 wherein atmospheric air is also delivered to the air cavity at an upper end thereof for delivery to the air compressor.

67. A vapor fuel separator system as set forth in claim 66 wherein the air cavity is provided with sufficient capacity so that if the vapor fuel separator is laid on its side, fuel will not flow from the air cavity out of the atmospheric air inlet.

68. A vapor fuel separator system as set forth in claim 55 wherein the pressure of the fuel regulated is regulated to provide a predetermined pressure difference between the air pressure regulated by the air pressure regulator and the fuel pressure regulated by the fuel pressure regulator.

69. A vapor fuel separator system as set forth in claim 68 further including means for shutting off the supply of high pressure air to the fuel/air injectors if the fuel pressure supplied to the fuel injectors falls below a predetermined value.

70. A vapor fuel separator system for an fuel/air injection system of an internal combustion engine comprising a housing defining a fuel cavity to which fuel is delivered, an air cavity in said housing above said fuel cavity and communicating therewith, a filter media filling said air cavity, a high pressure fuel pump for pumping fuel from said fuel cavity to a fuel injector supply circuit including a fuel pressure regulator that regulates fuel pressure by bypassing excess fuel back to said fuel cavity, and an air compressor for drawing air from said air cavity and delivering said air to the fuel-/air injector through an air circuit including an air pressure regulator which controls air pressure by returning excess air to said air cavity.

71. A vapor fuel separator system as set forth in claim 70 wherein atmospheric air is also delivered to the air cavity at an upper end thereof for delivery to the air compressor.

72. A vapor fuel separator system as set forth in claim 71 wherein the air cavity is provided with sufficient capacity so that if the vapor fuel separator is laid on its side, fuel will not flow from the air cavity out of the atmospheric air inlet.

73. A vapor fuel separator system as set forth in claim 72 wherein the associated engine has a pair of cylinder banks disposed at an angle and defining a valley therebetween.

74. A vapor fuel separator system as set forth in claim 73 wherein the vapor fuel separator is disposed in the valley between the cylinder banks.

75. A vapor fuel separator system as set forth in claim 74 wherein the engine forms a powering internal combustion engine of a power head of an outboard motor supported for tilt adjustment.

76. A vapor fuel separator system as set forth in claim 75 wherein the vapor fuel separator is resiliently mounted on the engine in the valley.

77. A vapor fuel separator system as set forth in claim 76 wherein the vapor fuel separator comprises a float operated needle valve for controlling the level of fuel in the fuel cavity.

78. A vapor fuel separator system as set forth in claim 70 further including means providing an additional atmospheric air inlet to the air compressor independently of the air cavity.

79. A vapor fuel separator system as set forth in claim 78 wherein atmospheric air is also delivered to the air cavity at an upper end thereof for delivery to the air compressor.

80. A vapor fuel separator system as set forth in claim 79 wherein the air cavity is provided with sufficient capacity so that if the vapor fuel separator is laid on its side, fuel will not flow from the air cavity out of the atmospheric air inlet.

81. A vapor fuel separator system as set forth in claim 70 wherein the pressure of the fuel regulated is regulated to provide a predetermined pressure difference between the air pressure regulated by the air pressure regulator and the fuel pressure regulated by the fuel pressure regulator.

82. A vapor fuel separator system as set forth in claim 81 further including means for shutting off the supply of high pressure air to the fuel/air injectors if the fuel pressure supplied to the fuel injectors falls below a predetermined value.

83. A vapor fuel separator system as set forth in claim 80 further including means for shutting off the supply of high pressure air to the fuel/air injectors if the fuel pressure supplied to the fuel injectors falls below a predetermined value.

84. A vapor fuel separator system for an fuel/air injection system of an internal combustion engine comprising a housing defining a fuel cavity to which fuel is delivered, an air cavity in said housing above said fuel cavity and communicating therewith, a high pressure fuel pump for pumping fuel from said fuel cavity to a fuel injection supply circuit including a fuel pressure regulator that regulates fuel pressure by bypassing excess fuel back to said fuel cavity, and an air compressor for drawing air from said air cavity through an inlet and delivering said air to the fuel/air injector through an air circuit including an air pressure regulator which controls air pressure by returning excess air to said air cavity through an air return, at least one of said air inlet and said air return communicating with said air cavity at a location wherein tilting of said housing will not cause fuel to enter said one of said air inlet and said air return.

85. A vapor fuel separator system as set forth in claim 84 wherein the associated engine has a pair of cylinder banks disposed at an angle and defining a valley therebetween.

86. A vapor fuel separator system as set forth in claim 85 wherein the vapor fuel separator is disposed in the valley between the cylinder banks.

87. A vapor fuel separator system as set forth in claim 86 wherein the engine forms a powering internal combustion engine of a power head of an outboard motor supported for tilt adjustment.

88. A vapor fuel separator system as set forth in claim 87 wherein the vapor fuel separator is resiliently mounted on the engine in the valley.

89. A vapor fuel separator system as set forth in claim 88 wherein the vapor fuel separator comprises a float operated needle valve for controlling the level of fuel in the fuel cavity.

90. A vapor fuel separator system as set forth in claim 89 wherein the conduits delivering fuel and air to the fuel vapor separator are flexible conduits.

91. A vapor fuel separator system as set forth in claim 84 wherein the pressure of the fuel regulated is regulated to provide a predetermined pressure difference between the air pressure regulated by the air pressure regulator and the fuel pressure regulated by the fuel pressure regulator.

92. A vapor fuel separator system as set forth in claim 91 further including means for shutting off the supply of high pressure air to the fuel/air injectors if the fuel pressure supplied to the fuel injectors falls below a predetermined value.

93. A vapor fuel separator system as set forth in claim 84 further including means for shutting off the supply of high pressure air to the fuel/air injectors if the fuel pressure supplied to the fuel injectors falls below a predetermined value.

94. A fuel/air injection system for an internal combustion engine comprising an air compressor for compressing air, a fuel pump for pumping fuel, a vapor fuel separator for receiving fuel pumped by said fuel pump and separating the vapor therefrom, said air compressor drawing at least a portion of the air compressed thereby from said vapor fuel separator, and a separate air inlet for supplying air to said air compressor.

95. An air/fuel pressure regulatory system for an fuel/air injection system comprising an air compressor for compressing air, an air pressure regulatory for regulating the pressure of the air supplied by said air compressor to a fuel/air injector, a fuel pump for pressurizing fuel for said fuel/air injector, a fuel pressure regulatory having a regulating valve opened and closed to regulate fuel pressure, said regulating valve being opened and closed in response to the difference between the pressure generated by said fuel pump and the regulated air pressure and means for shutting off the supply of high pressure air to said fuel/air injector if the fuel pressure supplied to the fuel injector falls below a predetermined value.

96. An air pressure regulator system for a fuel/air injector for supplying high pressure fuel and air to an internal combustion engine, an air compressor for compressing air, a fuel pump for pumping fuel under pressure, an air pressure regulator for regulating the pressure of the air supplied by said air compressor to said fuel/air injector, and means for precluding the delivery of high pressure air to said fuel/air injector if said fuel pump does not pump fuel at a greater than a predetermined pressure.

* * * * *